United States Patent [19]

Smith

[11] Patent Number: 5,074,514

[45] Date of Patent: Dec. 24, 1991

[54] CHRISTMAS TREE HOLDER

[76] Inventor: David W. Smith, 238 Scarboro Avenue, SW., Calgary, Alberta, Canada, T3C 2H3

[21] Appl. No.: 441,987

[22] Filed: Nov. 28, 1989

[51] Int. Cl.[5] ..... F16M 13/00

[52] U.S. Cl. ..... 248/524; 248/188.7; 248/527; 47/40.5

[58] Field of Search ..... 248/524, 519, 523, 527, 248/188.7, 188.8, 188; 47/42, 40.5

[56] References Cited

U.S. PATENT DOCUMENTS

| | | | |
|---|---|---|---|
| 1,298,380 | 3/1919 | Owen | 248/523 |
| 1,598,362 | 8/1926 | Brice | 248/524 X |
| 1,997,870 | 4/1935 | Merrill | 248/524 |
| 2,044,192 | 6/1936 | Templin | 248/527 |
| 2,913,202 | 11/1959 | Meldrum | 248/523 X |
| 3,298,643 | 1/1967 | Taylor | 248/523 X |
| 3,350,043 | 10/1967 | Apple | 47/40.5 |
| 4,034,505 | 7/1977 | Lydall | 248/527 X |
| 4,591,126 | 5/1986 | Berney | 248/524 |

*Primary Examiner*—David M. Purol

*Attorney, Agent, or Firm*—Terry M. Gernstein

[57] ABSTRACT

The holder comprises a pot having a screw for fixing a tree stump in the pot chamber by clamping it against the opposite wall of the pot. The wall of the pot forms three inwardly and slightly upwardly extending cylindrical cavities at its base. Three legs are provided, one for each cavity. Each leg has a cylindrical spigot at its inner end and a main shank. The longitudinal axis of the spigot is offset slightly, relative to the axis of the shank. When the spigots are inserted into the cavities so that the legs are assembled with the pot and the assembly is nesting on a support surface, then manual rotation of a single leg will induce tilting of the pot. Thus there is provided a holder having a single screw clamping system and a rotatable leg levelling system.

10 Claims, 6 Drawing Sheets

CHRISTMAS TREE HOLDER

FIELD OF THE INVENTION

This invention relates to a holder or stand for a small tree, such as a Christmas tree.

BACKGROUND OF THE INVENTION

Applicants set out to produce an improved Christmas tree holder. In this connection, they surveyed the available commercial products and noted the following:

That typically a leg-supported elevated pot was used to receive and support the stump of the tree. The pot was stabilized by the outwardly and downwardly projecting legs. The pot further carried means, for grasping the stump, to unite it with the stable base provided by the legs. The pot served as a reservoir for water, to keep the tree from becoming unduly dry; and That typically the means for uniting the stump with the pot involved three or more screws extending through the upper end of the pot wall at spaced points around its rim. These screws served a second function — more particularly, they provided a means for adjusting the verticality of the tree. By the process of easing off one screw and further screwing in another, the tree could be tilted, although the levelling of the pot remained unchanged.

In applicants' view, there were shortcomings which characterized the prior art products seen. More particularly:

The three screw grasping/levelling system seemed to baffle some users. It appeared desirable to develop a simpler system for providing these two functions;

The pot used was typically difficult to keep filled with water, as it was awkward to pour the water into the narrow annular space between the surface of the stump and the inner surface of the pot; and There was no useful means provided for testing the water level in the pot.

SUMMARY OF THE INVENTION

In accordance with the invention, there is provided first means for clamping and supporting the stump of a tree to hold the tree upright, said first means being associated with three removable legs. Preferably the first means comprises a pot. The pot forms three outwardly directed and downwardly angled cylindrical first surfaces. The first surfaces are provided at spaced points about the periphery of the pot base. The first surfaces may be provided by forming the pot wall to create inwardly extending cavities or outwardly projecting protuberances or spigots. The inner (or upper) end portion of each leg is formed to provide a cylindrical second surface adapted to longitudinally engage one of the pot's cylindrical first surfaces, to interlock the leg with the pot. For example, the pot may form cylindrical cavities and the inner end end of each leg may take the form of a cylindrical spigot which closely fits one of the cavities. Or alternatively, the pot may form the spigots and each leg upper end portion may form a cavity.

A cylindrical configuration for the first and second surfaces is chosen to enable the leg to be rotated relative to the pot while maintaining the interlocking relationship. The tolerance or fit of the spigot in the cavity is preferably sufficiently close or tight to ensure a friction fit so that the leg remains engaged with the pot if they are raised off the support surface and to further ensure that the leg will not counter-rotate when the pot is loaded with the tree; however the fit is loose enough so that one cylindrical surface can be rotated manually relative to the other and, preferably, the leg can be separated from the pot by pulling manually on the leg. The shank of the leg is several times as long as the spigot. When tree load is applied to the pot, the combination of close fit and leg section ratio will result in high friction or binding taking place between pot and spigot, thereby better resisting counter-rotation.

In a preferred feature, a single screw, extending through one side of the pot, is used to clamp the tree stump against the opposite side of the pot. In this embodiment, therefore, the grasping function is enabled by a single screw cooperating with the pot wall to form a vice and the levelling function is enabled by manual rotation of the legs, one at a time.

In another preferred feature, the pot is formed to provide an upper portion of reduced diameter and a base portion of expanded diameter. An outwardly projecting, almost horizontal shoulder portion joins the upper and base portions of the pot side wall. An aperture or fill hole is formed in this shoulder portion. The fill hole is large enough to permit insertion of a finger. By this design, there is provided a relatively large water reservoir that is easy to fill and which can be tested for water level by insertion of a finger through the fill hole.

In another preferred feature, the pot is formed of plastic and the cylindrical first surfaces are provided by having inwardly extending, slightly tapered cavities. The taper of the cavities is necessitated by having to use a die in the manufacture of the pot, which die has tapered parts for forming the cavities. Due to the taper, the pot wall has a tendency to expel the leg when the pot is loaded. To overcome this problem, while not interfering with the capability for manual rotation and removal of the leg, there is preferably provided means for retaining the leg in the cavity against expulsion by the loaded pot.

Broadly stated, the invention is a tree holder comprising: first means for clamping and supporting the stump of a tree to hold the tree upright; said first means comprising a base having a periphery, said first means forming three cylindrical first surfaces that are downwardly angled from horizontal and located at generally equally spaced apart positions around the periphery of the first means base; and three legs for supporting the first means in an elevated position, each leg having inner and outer end portions, said outer portion having a length that is several times the length of the inner portion, which combine to form a unit so that the leg portions will turn together, said inner end portion forming a cylindrical second surface adapted to longitudinally engage one of the cylindrical first surfaces to interlock with the first means with a tolerance that is sufficiently close so that the leg will not counter-rotate when the first means is loaded with a tree but that is sufficiently loose so that the leg may still be manually rotated, the outer end portion and cylindrical second surface of each leg each having a longitudinal axis, said axes being generally linearly aligned but offset and intersecting each other at a small acute angle relative to each other; whereby, when the legs are interlocked with the first means and the resulting assembly is resting on a support surface, manual rotation of a leg induces tilting of the first means.

In a variant of the invention, an auxiliary cylindrical collar may be used between the cylindrical leg surface and the cylindrical pot surface. The axes of the outer and inner surfaces of this auxiliary collar are offset to each other (typically 5°). In this case, the leg is straight and has only a single axis. Rotation of the collar causes the outer end of the leg to move in the circular path, even though the leg itself is not rotated.

DESCRIPTION OF THE PREFERRED EMBODIMENT

Figure 1:
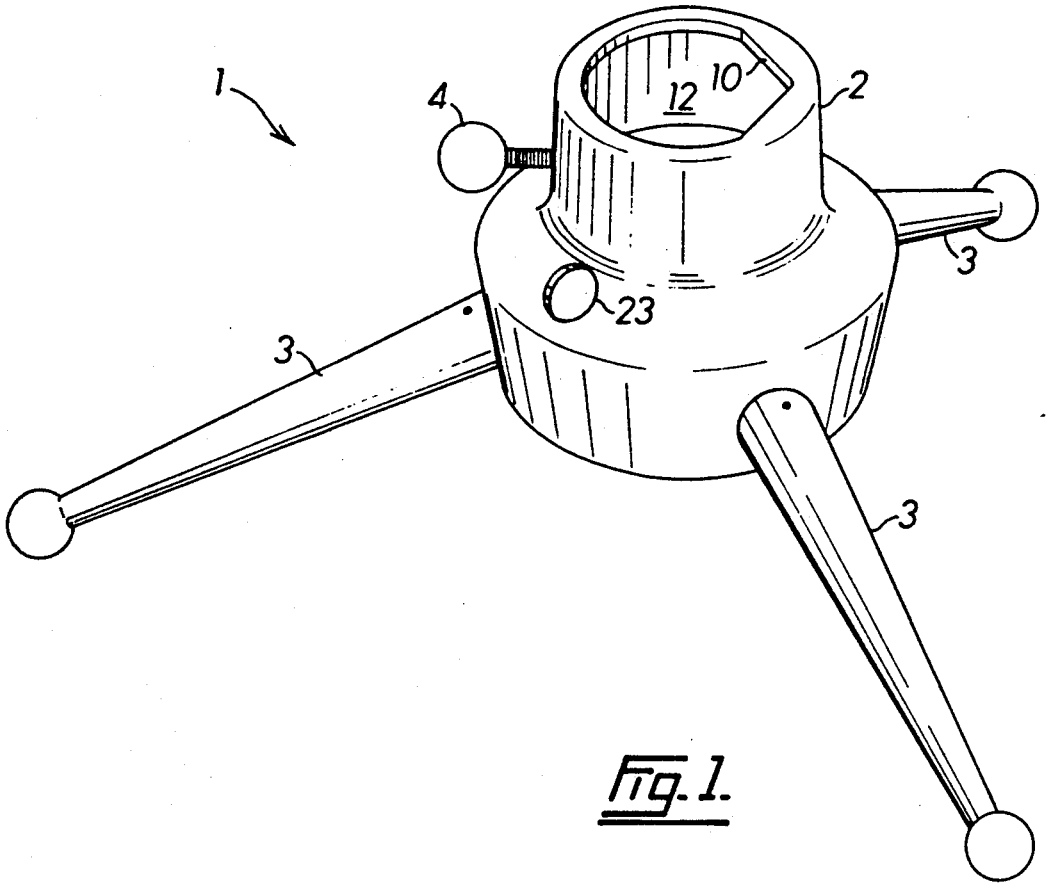
FIG. 1 is a perspective view of the holder with the legs each in the maximum elevation position.
Figure 2:
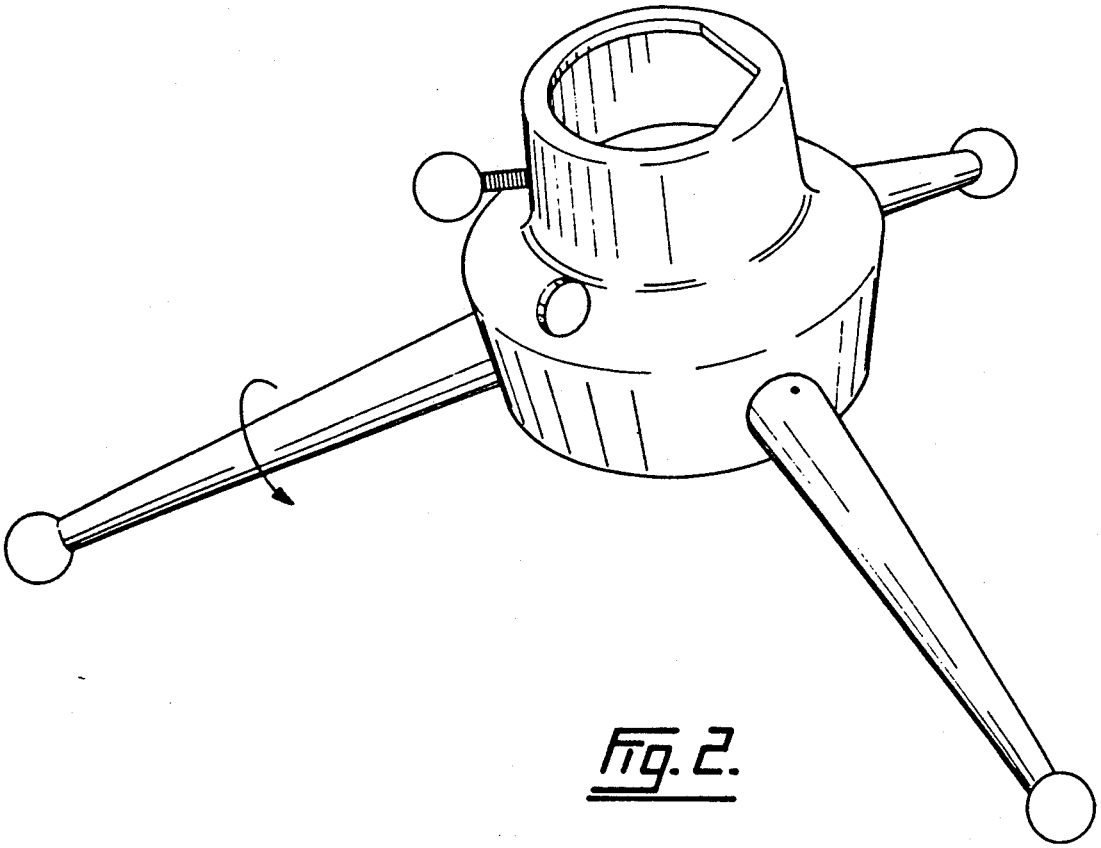
FIG. 2 is a perspective view similar to FIG. 1 except that one of the legs has been rotated to tilt the pot.
Figure 3:
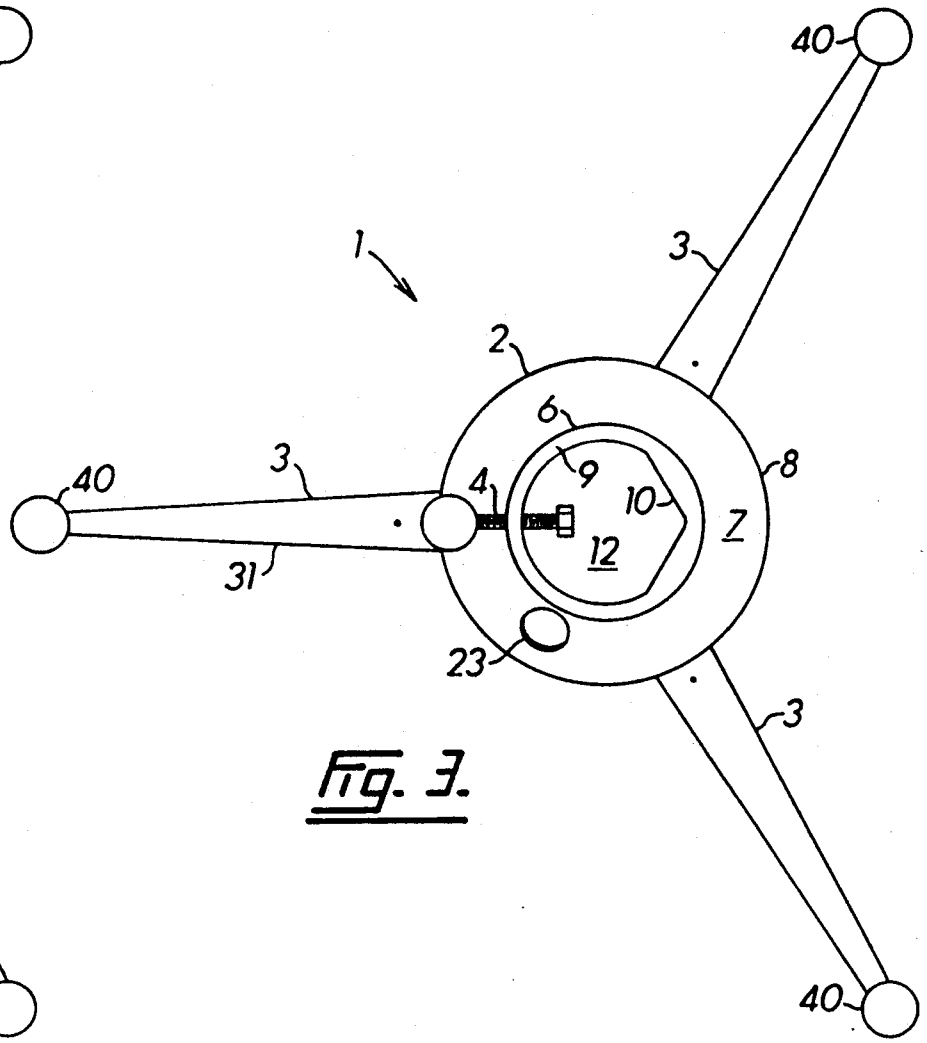
FIG. 3 is a top plan view of the holder.
Figure 4:
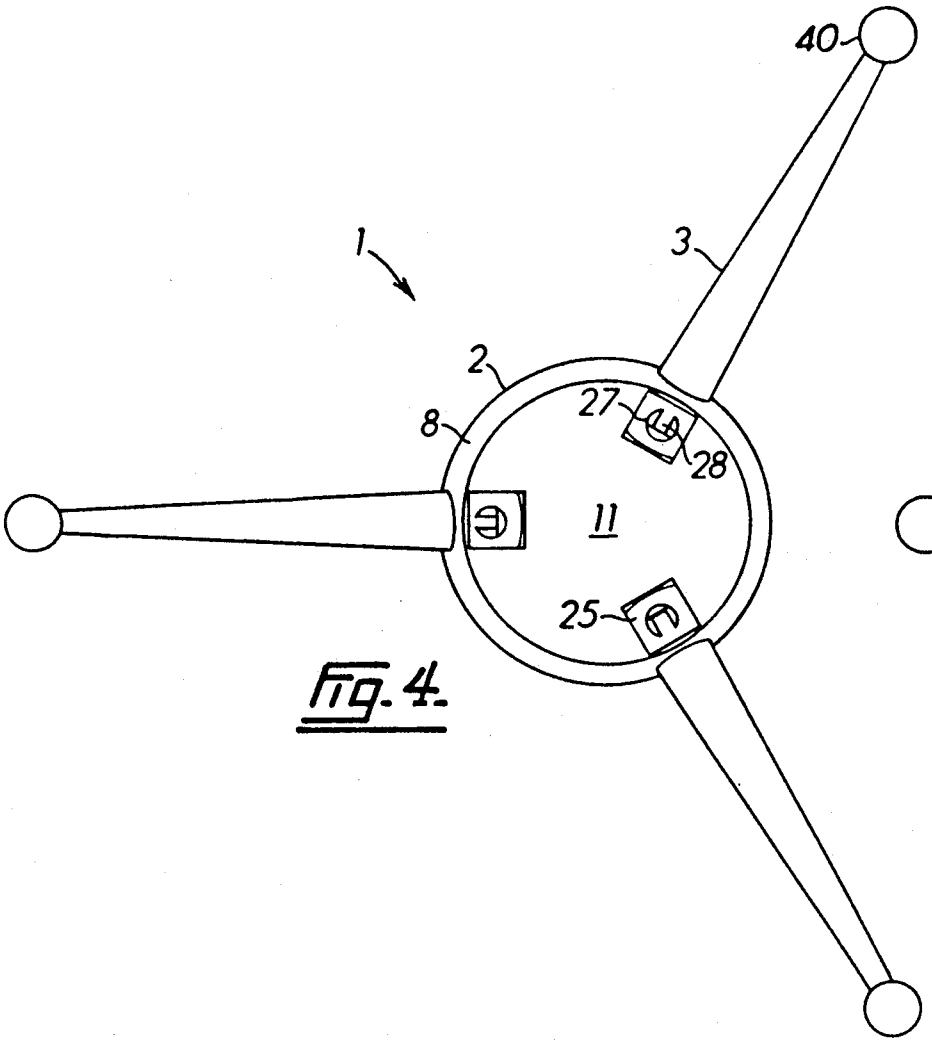
FIG. 4 is a bottom plan view of the holder.
Figure 5:
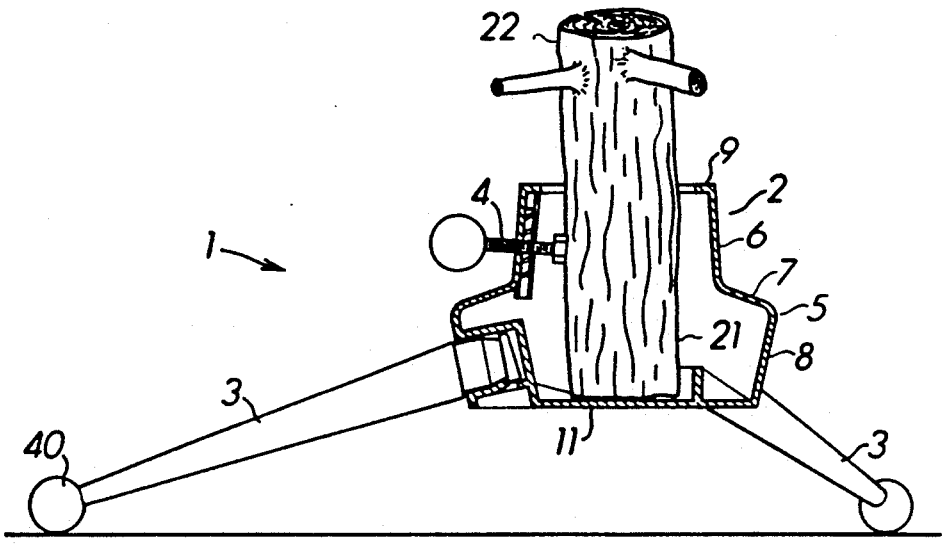
FIG. 5 is a sectional side view showing the pot, legs, screw and stump.
Figure 6:
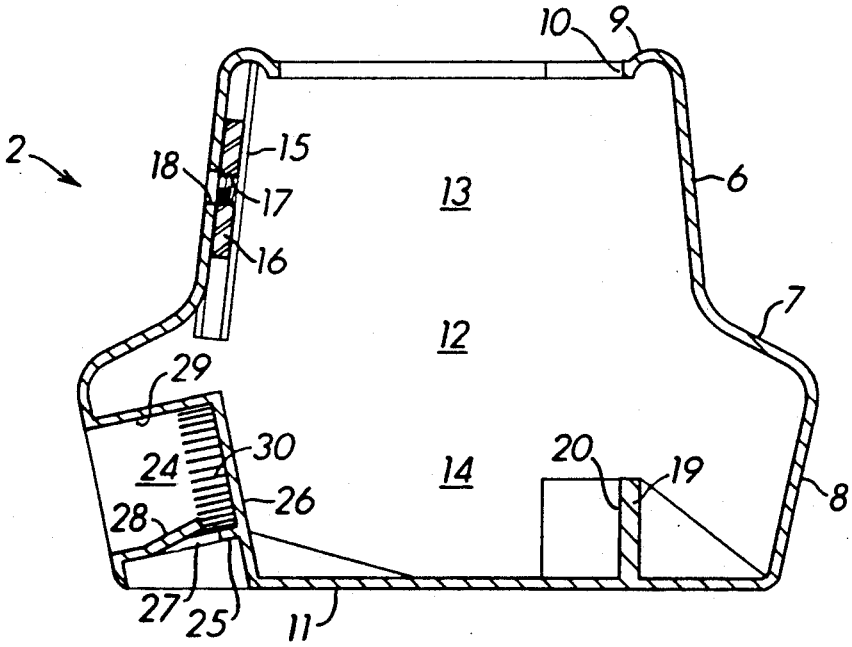
FIG. 6 is an expanded sectional side view of the pot alone, showing one of the cavities.
Figure 7:
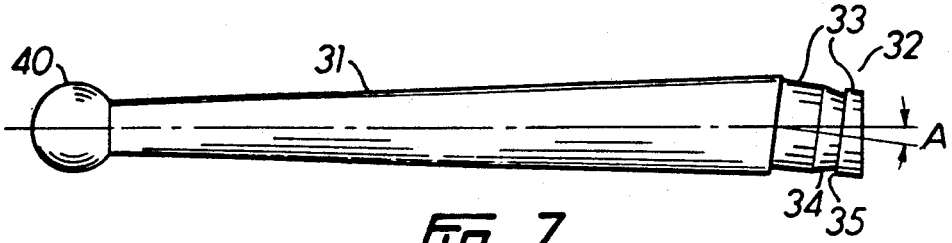
FIG. 7 is a side view of one embodiment of the leg.
Figure 8:
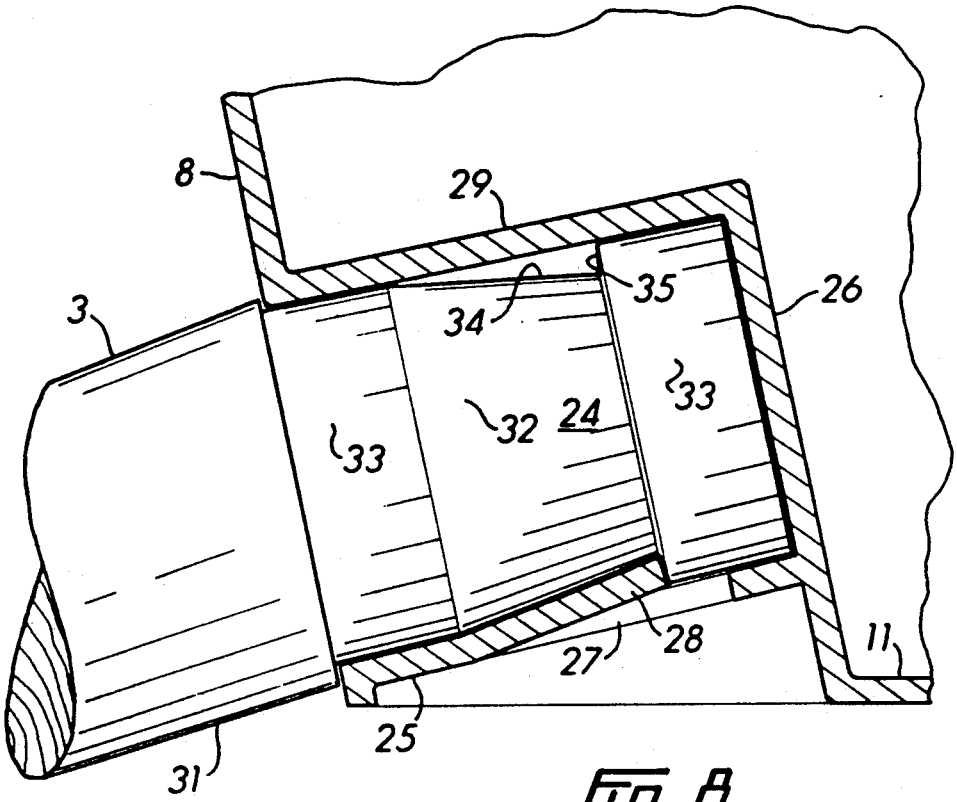
FIG. 8 is a side sectional view showing part of the pot, forming a cavity, the pot having keeper means for resisting expulsion of the leg by the pot.
Figure 9:
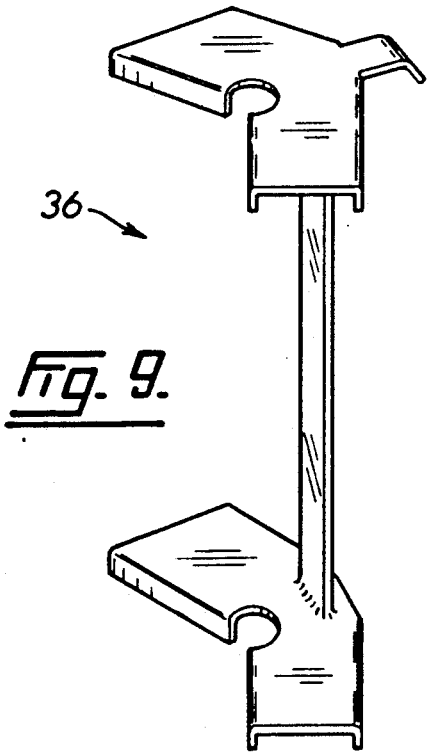
FIG. 9 is a perspective view of a spacer supplied for use with trees of small diameter.

The holder 1 comprises a plastic pot 2 having three identical wooden legs 3 and a steel, threaded clamping screw 4.

More particularly, the pot 2 is open-topped and flat-bottomed. It has a side wall 5 forming a generally cylindrical but upwardly tapered upper portion 6, an outwardly flaring shoulder portion 7, and a generally cylindrical but inwardly tapered lower portion 8. The side wall 5 is inwardly bent at its upper end to provide an inwardly projecting flange 9, forming a V-notch 10 at one side. A transverse bottom wall 11 connects with the side wall 5. The open-topped pot 2 thus forms an interior chamber 12 having a reduced diameter upper portion 13 and an expanded diameter lower reservoir portion 14.

In opposed relation to the V-notch 10, the side wall upper portion 6 forms a pair of inwardly projecting, vertically extending, parallel angle members 15. A steel plate 16 is retained by the angle members 15. The plate 16 has a threaded aperture 17 which is aligned with an aperture 18 extending through the side wall upper portion 6. The apertures 17, 18 are opposed to the apex of the V-notch 10. The clamping screw 4 extends through the apertures 17, 18 and threadably engages the plate 16.

The side wall lower portion 8 and bottom wall 11 together form a short, upstanding wall 19 at the base of the chamber 12. The wall 19 forms a V-notch 20. The apex of the V-notch 20 is vertically aligned with that of the V-notch 10.

In operation, therefore, the flat-bottomed stump 21 of a tree 22 is inserted in chamber 12 and is supported by bottom wall 11. The bolt 4 may be screwed inwardly to clamp the stump 21 against the v-notch-forming wall 19 and flange 9.

The pot 2 and screw 4 thus combine to provide means for clamping and supporting the stump of a tree 22 in an elevated position, to hold the tree upright.

The side wall shoulder portion 7 forms a fill hole 23 of sufficient diameter to permit of insertion of a finger, to test the water level in the chamber reservoir portion 14.

The side wall lower portion 8 and bottom wall 11 further cooperate to form three inwardly extending, cylindrical cavities 24. More particularly, the bottom wall 11 has an arcuate portion 25 that combines with part 26 of the side wall 5 to form each cavity 24.

Each arcuate portion 25 forms an aperture 27 and tang 28. The tang 28 is inwardly bent but can be flexed outwardly into the aperture 27. The operation of the tang 28 is described below.

The cylindrical side surface 29 of each cavity 24 projects downwardly and outwardly at a slight angle (e.g. 7°) from horizontal.

The cavity side surface 29 forms a series of inwardly projecting, short, spaced apart ribs 30 at its inner end. The purpose of the ribs 30 is described below.

Turning now to the wooden legs 3, each has an elongated, straight shank 31 and a short spigot 32 at its inner end. The longitudinal axis of the spigot 32 is offset relative to the longitudinal axis of the shank 31 (typically 5°). Stated otherwise, the axes are coplanar and generally linearly aligned, but offset at an acute angle relative to each other.

The spigot 32 has a cylindrical second surface 33 which closely conforms to the cylindrical first surface 29 of the cavity 24. The fit of the spigot 32 in the circle of ribs 30 is designed to permit the leg 3 to be rotated manually but there is sufficient frictional resistance to rotation so as to ensure that the leg 3 will not counterrotate when the tree 22 is loaded onto the pot 2. The tolerance of this fit will be affected by the materials from which each of the leg 3 and pot 2 are made.

The spigot 32 is notched to provide a circumferential groove 34 part way along its length. The inner end of the groove 34 is defined by the shoulder 35. When the spigot 32 is inserted into a cavity 24, the tan 28 locks against the shoulder 35 to provide resistance to expulsion by the pot when the latter is loaded. However, the flexing capability of the tang 28 will enable the spigot 32 to be manually withdrawn from the cavity 24 by pulling on the shank 31, or by pulling the tang 28 clear of the spigot 32.

A spacer 36 is provided, as shown, to bring the V-notch surfaces closer to the opposite side wall, if required.

In operation, the legs 3 are inserted into the cavities 24 to suspend the pot 2 in an elevated position. The legs 3 provide a stable and wide platform for the pot 2. The screw 4 is screwed in to clamp the stump 21 against the wall 19 and flange 9, thereby locking the pot 2 and tree together. When a single leg 3 is rotated, the cylindrical surfaces 29, 33 and the offset spigot 32 and shank 31 interact to induce the pot 2 to tilt and vary the verticality of the tree.

Figure 10:
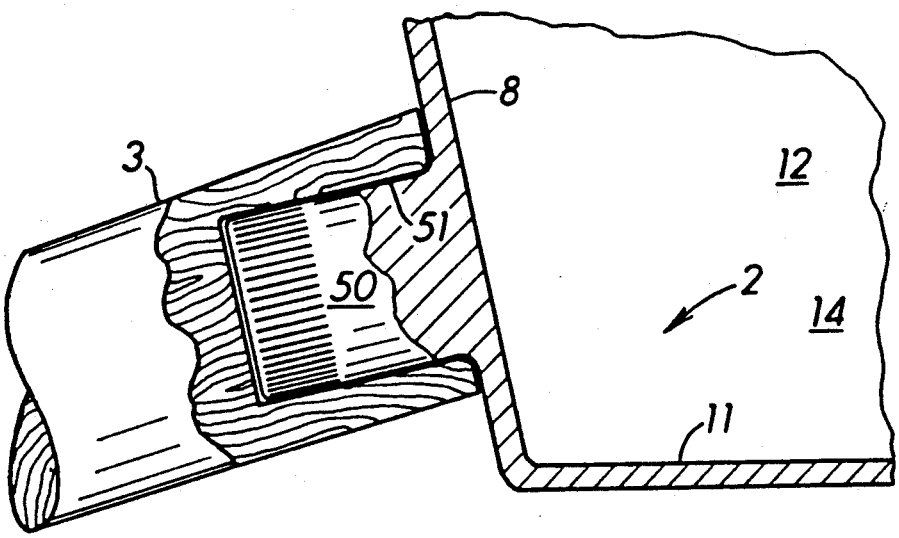
FIG. 10 is a side sectional view showing part of a pot, having a spigot extending therefrom, and part of a leg forming a cooperating cavity therefore.
Figure 11:
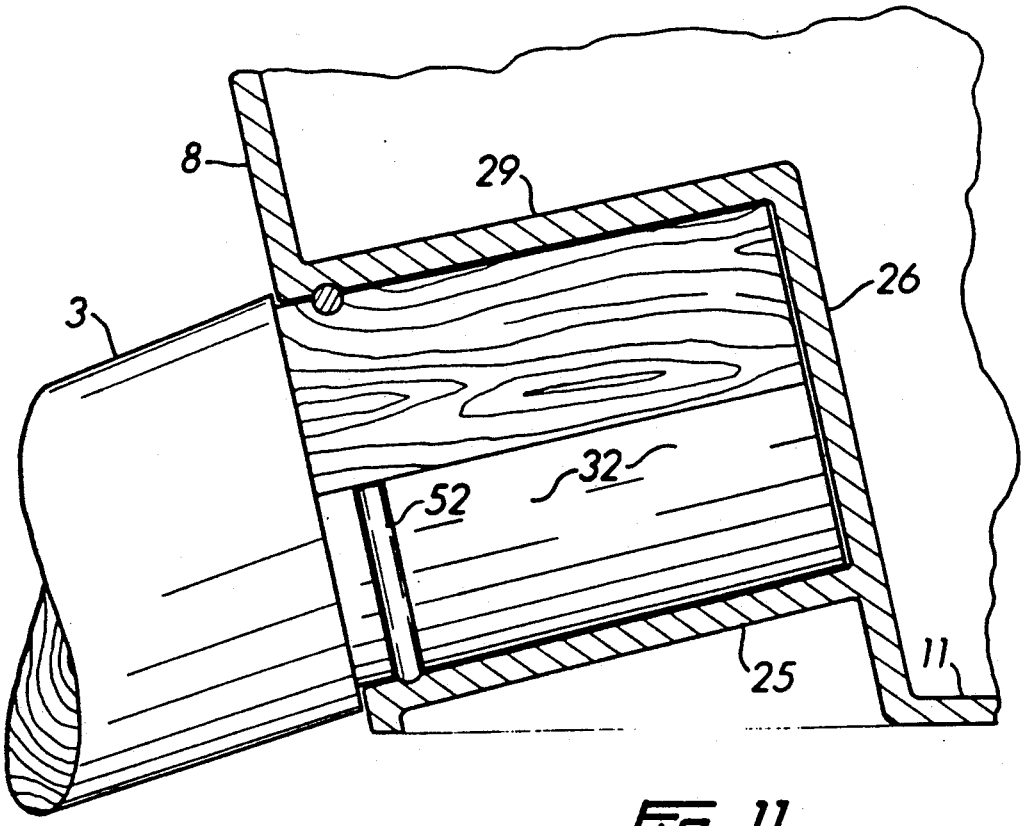
FIG. 11 is a side sectional view showing part of a pot and spigot having an O-ring on the spigot as the keeper.

FIGS. 10 and 11 show alternative features that may be used in place of specific features previously described. More particularly, FIG. 10 shows the pot 2 formed with spigots 50, instead of cavities. Each leg 3 forms a cooperating cavity 51. FIG. 11 shows a rubber O-ring 52 being used instead of a tang to resist expulsion of the leg 3 by the pot 2 when the latter is loaded.

Figure 12:
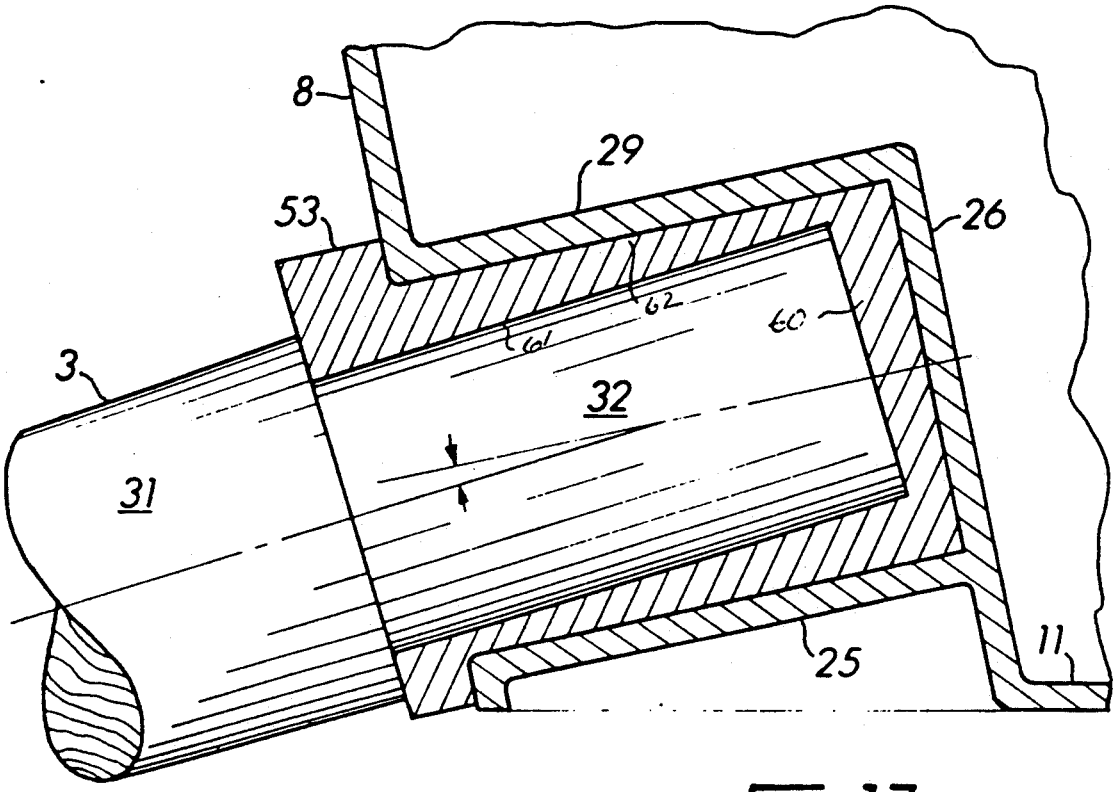
FIG. 12 is a side sectional view of part of the pot and the leg, showing an alternative form of the invention.

FIG. 12 shows a variant of the invention. A generally cylindrical collar 6, having inner and outer cylindrical surfaces 61, 62, is interposed between a cylindrical cavity surface of a pot and the cylindrical surface of a leg. The axes of the surfaces 61, 62 are offset to each other. Thus, manual rotation of the collar 60 may be used to cause the outer end of the leg to move in a circular path, even though the leg itself is not rotated.

The scope of the invention is defined by the appended claims.

The embodiments of the invention in which an exclusive property of privilege is claimed are defined as follows:

1. A tree holder comprising:

first means for clamping and supporting the stump of a tree to hold the tree upright;

said first means comprising a base having a periphery, said first means forming three cylindrical first surfaces that are downwardly angled from horizontal and located at generally equally spaced apart positions around the periphery of the first means base; and three legs for supporting the first means in an elevated position, each leg having inner and outer end portions, said outer portion having a length that is several times the length of the inner portion, which combine to form a unit so that the leg portions will turn together, said inner end portion forming a cylindrical second surface adapted to longitudinally engage one of the cylindrical first surfaces to interlock with the first means with a tolerance that is sufficiently close so that the leg will not counterrotate when the first means is loaded with a tree but that is sufficiently loose so that the leg may still be manually rotated, the outer end portion and cylindrical second surface of each leg each having a longitudinal axis, said axes being generally linearly aligned but offset and intersecting each other at a small acute angle relative to each other;

whereby, when the legs are interlocked with the first means and the resulting assembly is resting on a support surface, manual rotation of a leg induces tilting of the first means.

2. The tree holder as set forth in claim 1 wherein:

the first means comprises a pot forming the first surfaces.

3. A tree holder comprising:

a pot having means for clamping and supporting the stump of a tree to hold the tree upright;

said pot comprising a base having a periphery, said pot forming three cylindrical first surfaces that are downwardly angled from horizontal and located at generally equally spaced apart positions around the periphery of the pot base; and three legs for supporting the pot in an elevated position, each leg having inner and outer end portions, said outer portion having a length that is several times the length of the inner portion, which combine to form a unit so that the leg portions will turn together, said inner end portion forming a cylindrical second surface adapted to longitudinally and frictionally engage one of the cylindrical first surfaces to interlock with the pot with a tolerance that is sufficiently close so that the leg will not counterrotate when the pot is loaded with a tree but is sufficiently loose so that the leg may still be manually rotated or withdrawn, the outer end portion and cylindrical second surface of each leg each having a longitudinal axis, said axes being generally linearly aligned but offset and intersecting each other at a small acute angle relative to each other;

whereby, when the legs are interlocked with the pot and the resulting assembly is resting on a support surface, manual rotation of a leg induces tilting of the pot.

4. The tree holder as set forth in claim 3 wherein:

the pot has a side wall and is associated with a screw, extending through the side wall, for clamping the stump against the portion of the side wall opposite to the screw.

5. The tree holder as set forth in claim 2 or 4 wherein:

the pot forms three inwardly projecting cavities that define the first surfaces and the inner end portion of each leg is an offset spigot which provides the second surface for engaging one of the cavities to interlock with the pot.

6. The tree holder as set forth in claim 3 or 4 wherein:

the pot is formed to provide a base portion of relatively expanded diameter, a top portion of relatively reduced diameter, and an intermediate outwardly projecting shoulder portion connecting the base and top portions, said shoulder portion forming a fill aperture of sufficient size to permit insertion therethrough of a finger.

7. The tree holder as set forth in claim 3 or 4 wherein:

the pot forms three inwardly projecting cavities that define the first surfaces and the inner end portion of each leg is an offset spigot which provides the second surface for engaging one of the cavities to interlock with the pot; and the pot is formed to provide a base portion of relatively expanded diameter, a top portion of relatively reduced diameter, and an intermediate outwardly projecting shoulder portion connecting the base and top portions, said shoulder portion forming a fill aperture of sufficient size to permit insertion therethrough of a finger.

8. The tree holder as set forth in claim 3 or 4 wherein:

the pot is formed of plastic and forms three inwardly projecting cavities that define the first surfaces; and the pot comprises means for releasably locking the leg inner end portion inserted in the cavity, said means being adapted to permit the leg inner end portion to be manually rotated within or withdrawn from the cavity yet maintaining sufficient purchase on the portion to prevent it being expulsed from the cavity when the pot is loaded with the tree.

9. The tree holder as set forth in claim 5 wherein:

the pot is formed of plastic; and the pot comprises means for releasably locking the spigots when inserted in the cavities, said means being adapted to permit the leg to be manually rotated within or withdrawn from the cavity yet maintaining sufficient purchase on the spigot to prevent it being expulsed from the cavity when the pot is loaded with the tree.

10. The tree holder as set forth in claim 3 or 4 wherein:

the pot forms three inwardly projecting cavities that define the first surfaces and the inner end portion each leg is an offset spigot which provides the second surface for engaging one of the cavities to interlock with the pot;

the pot is formed to provide a base portion of relatively expanded diameter, a top portion of relatively reduced diameter, and an intermediate outwardly projecting shoulder portion connecting the base and top portions, said shoulder portion forming a fill aperture of sufficient size to permit insertion of a finger;

the pot is formed of plastic; and the pot comprises means for releasably locking the leg inner end portion inserted into each cavity, said means being adapted to permit the leg inner end portion to be maintaining rotated within or withdrawn from the cavity yet maintaining sufficient purchase on the portion to prevent it being expulsed from the cavity when the pot is loaded with the tree.

* * * * *